US006470724B1

(12) United States Patent
Friese

(10) Patent No.: US 6,470,724 B1
(45) Date of Patent: Oct. 29, 2002

(54) TOOL FOR PRODUCING A GEAR PART HAVING EXTERNAL TOOTHING

(75) Inventor: Udo Friese, Ahlen (DE)

(73) Assignee: WF-Maschinenbau und Blechformtechnik GmbH & Co.KG, Sendenhorst (DE)

( * ) Notice: Subject to any disclaimer, the term of this patent is extended or adjusted under 35 U.S.C. 154(b) by 0 days.

(21) Appl. No.: 09/806,753

(22) PCT Filed: Feb. 10, 1999

(86) PCT No.: PCT/DE99/00387

§ 371 (c)(1),
(2), (4) Date: Apr. 3, 2001

(87) PCT Pub. No.: WO00/21699

PCT Pub. Date: Apr. 20, 2000

(30) Foreign Application Priority Data

Oct. 8, 1998 (DE) ..... 298 17 979 U1

(51) Int. Cl.[7] ..... B21D 22/00

(52) U.S. Cl. ..... 72/84; 72/102; 72/107; 72/110; 72/121; 29/893.32

(58) Field of Search ..... 72/82, 83, 84, 72/102, 107, 110, 121; 29/893.32, 893.34

(56) References Cited

U.S. PATENT DOCUMENTS 1,568,648 A * 1/1926 White ..... 72/102
4,045,988 A * 9/1977 Anderson ..... 72/102
5,379,620 A * 1/1995 Greis ..... 72/102
5,711,174 A * 1/1998 Dohi et al. ..... 72/83
6,279,366 B1 * 8/2001 Sakaguchi ..... 72/84

FOREIGN PATENT DOCUMENTS

| | | |
|---|---|---|
| DE | 4335505 | 8/1994 |
| DE | 19613457 | 4/1997 |
| SU | 1224073 | 4/1986 |

* cited by examiner

*Primary Examiner*—Ed Tolan
(74) *Attorney, Agent, or Firm*—Barnes & Thornburg

(57) ABSTRACT

A tool for producing a gear part having external toothing using a method of shaping by compression or by rolling. Said tool comprises a receiving tool for supporting the work piece which is impinged upon by a projection. Said receiving tool is driven to perform a rotational movement. The tool includes a roller pivotal about an axis (Y) that is parallel to the axis (X) of the rotating receiving tool which hold the work piece. The roller can be adjusted in the direction of its Y axis in relation to the work piece. It is subdivided in the direction of its Y axis in order to carry out the compression method. The tooth height of the individual shaping areas increases while the crown circle remains the same across all shaping areas. The root radius of the individual shaping areas decreases and the tooth depth increases from one shaping area to the next shaping area. As a result, the tooth thickness at the root circle increases in all of the shaping areas.

11 Claims, 2 Drawing Sheets

1
2
3
4
4a
4b
4c
4d
5a
7
8
9
10
11
12
14
X
Y

TOOL FOR PRODUCING A GEAR PART HAVING EXTERNAL TOOTHING

BACKGROUND AND SUMMARY OF THE INVENTION

The invention relates to a tool and method for producing a gear part having an external toothing.

In the following, the term "work piece" relates to the blank which is to be machined or is partially machined. The term "compressing" indicates a metal forming process which is used for the production of rotationally symmetrical bodies using pressing tools. In the art, the term "shaping by rolling" or "compression rolling" is currently used for this method.

A tool of the above-mentioned type is described in German Patent Document DE 196 13 457 D1. The tool has several forming areas of increasing crown circles along a Y—Y axis. In this known arrangement, it is required that the forming tool or roller for each forming area not only move in the direction of the Y-axis, but the tool must also be moved back perpendicularly to the Y—Y axis. That is, the tool must be moved back radially, so that the next forming area can engage in the preformed tooth area of increased crown circle of the work piece.

In the case of this type of forming tool, the material of the work piece displaced by the tool is displaced into the space of the tooth to be formed, that is, into the space existing between the teeth of the tool. As a result, an unfolding or uncontrolled depositing of the displaced material of the work piece into the space of the tool occurs and thus within the tooth to be formed. The thus formed tooth in the work piece may have material deformations which are very difficult to control, such as folds or overlapping, and which can impair the stability of the tooth of the work piece to be produced.

It is an object of the invention to permit a production method as a result of a correspondingly constructed tool, in which an uncontrolled flowing of the displaced material does not occur in the area of the tooth to be formed, and which, in addition, avoids the additional movement of the forming roller previously required in the prior art.

It is also an object of the invention to suggest a method which permits a fast and cost-effective production of a gear part having an external toothing.

These objects, on which the invention is based, are achieved by a forming tool having several forming areas wherein the crown circle of the tool is the same for all forming areas and wherein different tooth depth of the forming areas is achieved by changing the root circle of the teeth of the tool.

In the arrangement according to the invention, the material of the work piece displaced by the teeth of the tool flows to the outside and can be removed therefrom after the completion of the gear wheel by a corresponding processing of the material.

According to the invention, the forming roller is disposed to be freely rotatable and therefore adapts without difficulty and gear-related couplings with the drive of the receiving tool to the teeth to be formed.

If required, it is naturally possible to insert a synchronous running device between the forming roller and the receiving tool.

In order to avoid an uncontrolled flowing of the material displaced by the teeth of the tool, it is further suggested according to the invention that a limiting device be provided at least in the edge area of the work piece. The limiting device is preferably formed by two interacting pressure rollers which hold the flowing-out material between one another, and optionally form and limit it.

In order to avoid a superfluous flowing-out of material, it is also suggested according to the invention that the circumferential area of the work piece to be deformed be optimized. For example, the circumferential area is curved concavely toward the inside or recessed by way of linear surfaces toward the inside, so that only as much material exists in the circumferential area of the work piece as is required for the forming of the actual tooth.

The method according to the invention is characterized essentially in that several forming rollers can simultaneously be used on the work piece. As a result, the pressure on the receiving tool, which occurs by pressing the forming roller into the work piece, is minimized because this pressure is absorbed by the optionally opposite forming roller.

Here, two, three or several forming rollers can be provided on the circumference of the work piece.

Finally, it is suggested according to the invention that the work piece is caused to carry out a rotating reciprocating movement, whereby the two flanks of the formed tooth are uniformly acted upon by the forming roller so that differences in the tooth flanks are avoided here.

In the following, an embodiments of the invention will be explained by means of the drawings.

DETAILED DESCRIPTION OF THE PREFERRED EMBODIMENTS

Figure 1:
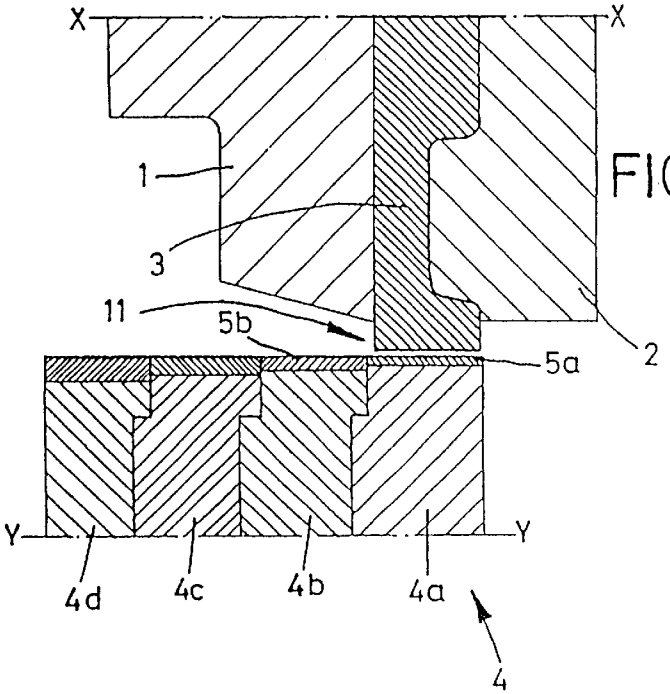
FIGS. 1 and 2 are sectional views of the different stages of the forming tool relative to the work piece according to the principles of the present invention.

A receiving tool 1 is illustrated in the drawings which rotates about an axis X—X. A work piece 3 or blank is fixed on the receiving tool 1 by a placing device 2. A forming tool or roller 4 consists, for example, of four individual forming areas 4*a*, 4*b*, 4*c* and 4*d*. The forming roller 4 can rotate about an axis Y—Y and is disposed in a free rotatable manner. The forming areas 4*a*, 4*b*, 4*c* and 4*d* have the same crown circle and increase tooth depths produced by decreasing radius of the root circles of the teeth.

The receiving tool 1 is driven in a rotatable manner and preferably in a reciprocate rotating movement which may amount to, for example, 180° or 120°. Two or more forming tools 4 may be used a shown in FIG. 4.

At the start of the operation, the forming area 4*a* a is adjusted or positioned with respect to the radial outer edge of the work piece 3 and is then applied to the work piece 3. The tooth area 5*a* of forming area 4*a* is brought in contact with the outer edge of the work piece 3 and a recess is formed by pressing. Subsequently, the work piece 3 or blank is caused to rotate.

Figure 2:
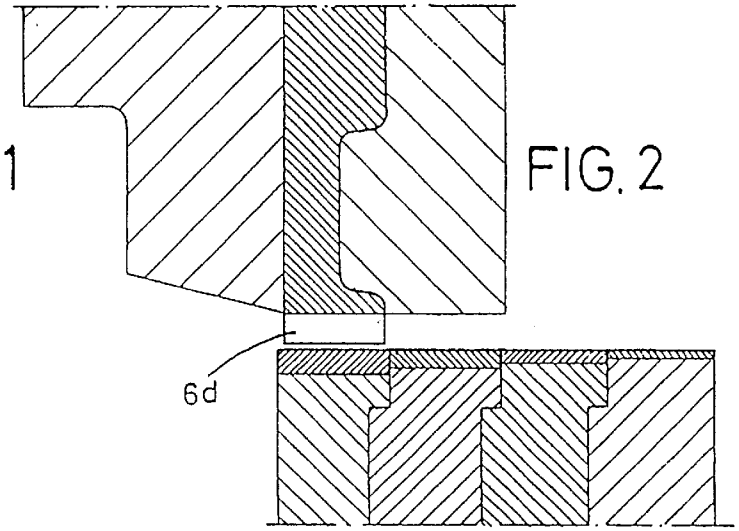
Figure 3:
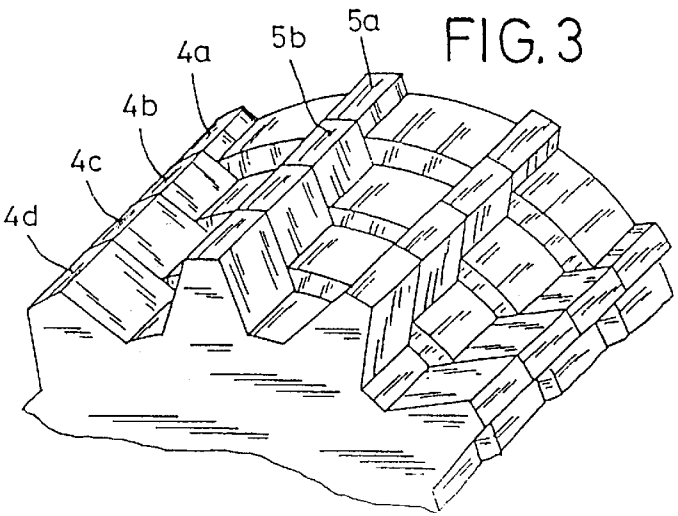
FIG. 3 is a diagrammatic representation of the forming tool.

Then, the forming roller 4 is further adjusted or moved in the direction of its Y-axis by one forming area, so that the tooth area 5*b* of the forming area 4*b* can be brought in contact with the work piece 3. A tooth area is thereby formed which is deeper in comparison to the preceding tooth area. The last recess in the work piece 3 formed by the forming area 4*d* has the reference number 6*d* in FIG. 2.

Figures 4, 5, 6:
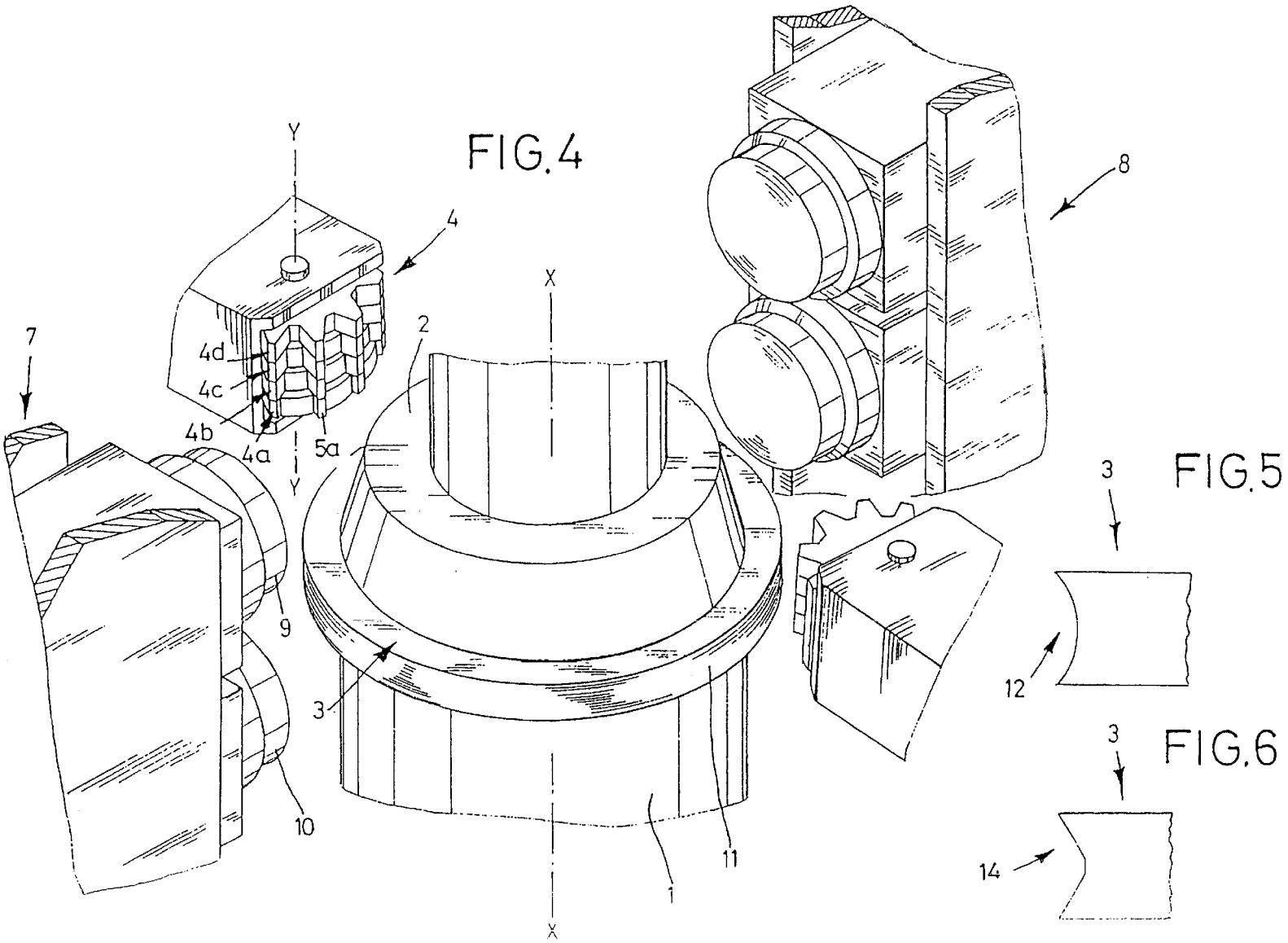
FIG. 4 is a diagrammatic representation of an arrangement for producing a toothed gear part by [means of] the forming tools according to the invention.
FIGS. 5 and 6 are views of two embodiments of the circumferential areas of the work piece.

In the embodiment illustrated in FIG. 4, limiting devices 7 and 8 are provided. In FIG. 4, they are shown disengaged from the circumferential area 11 of the work piece 3, for example, a round blank, but when the operation is carried out the limiting devices 7 and 8 are situated in the circumferential area 11. Each limiting device 7 and 8 has pressure rollers 9 and 10 which now prevent an uncontrolled flowing of the material displaced by the teeth, for example, 5*a*.

FIG. 5 is a sectional view of another embodiment of the circumferential area 11 of the work piece 3 which has a concave curvature 12 for optimizing the flowing-off material; while according to the embodiment of FIG. 6, this optimization is achieved by linear notches or recesses 14.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A tool for producing a gear part having an external toothing by a pressing method, the tool comprising:

a receiving tool which is rotatable about a first axis and which carries the work piece;

a forming roller which is rotatable about a second axis parallel to the first axis, which is adjusted along the second axis with respect to the work piece and which is divided along the second axis into several successive forming areas having the same crown circle and decreasing radius of the root circle of the individual forming areas, whereby the tooth depth and the tooth thickness on the root circle increase along the second axis.

2. The tool according to claim 1, wherein the forming roller is movable perpendicular to the second axis for implementing the pressing method upon the work piece.

3. The tool according to claim 1, including at least two forming rollers circumferentially spaced about the work piece.

4. The tool according to claim 3, wherein the receiving tool is reciprocally rotated less than 360 degrees.

5. The tool according to claim 1, wherein the forming roller is freely rotatable.

6. The tool according to claim 1 further including at least one limiting device in an edge area of the work piece with two interacting pressure rollers.

7. The tool according to claim 1, wherein a circumferential area of the work piece is shaped to optimize the reduction of the flowing-off material during the pressing method.

8. A method for producing a gear part having an external toothing, the method comprising:

simultaneously pressing at least two forming rollers, freely rotatable about first and second parallel axes which are circumferentially spaced, into a work piece carried and rotated about a third axis parallel to the first and second axes;

moving the forming rollers, each of which is divided in the direction of its axis into several successive forming areas having the same crown circle and decreasing radius of the root circle of the individual forming areas, whereby the tooth depth and the tooth thickness on the root circle increase along the second axis.

9. The method according claim 8, further including moving the forming rollers perpendicular to its axis for implementing the pressing operation.

10. The method according claim 8, further including rotating the work piece in a reciprocal movement.

11. The method according claim 10, wherein the reciprocal movement is less than 360 degrees.

* * * * *